US006109281A

United States Patent [19]

Lowenthal

[11] Patent Number: 6,109,281

[45] Date of Patent: Aug. 29, 2000

[54] SUNSHADE DEVICE

[75] Inventor: Hans Lowenthal, London, United Kingdom

[73] Assignee: Jacpaq Limited, United Kingdom

[21] Appl. No.: 09/051,780

[22] PCT Filed: Oct. 8, 1996

[86] PCT No.: PCT/GB96/02458

§ 371 Date: Apr. 16, 1998

§ 102(e) Date: Apr. 16, 1998

[87] PCT Pub. No.: WO97/14863

PCT Pub. Date: Apr. 24, 1997

[30] Foreign Application Priority Data

| | | | |
|---|---|---|---|
| Oct. 16, 1995 | [GB] | United Kingdom | 9521134 |
| Apr. 25, 1996 | [GB] | United Kingdom | 9608466 |
| Jun. 5, 1996 | [GB] | United Kingdom | 9611662 |

[51] Int. Cl.[7] ..... E04H 15/40

[52] U.S. Cl. ..... 135/125; 135/97; 135/117; 135/137; 135/143

[58] Field of Search ..... 135/125, 126, 135/97, 128, 134, 137, 143, 115, 117, 907, 120.4

[56] References Cited

U.S. PATENT DOCUMENTS

| | | | |
|---|---|---|---|
| 2,266,853 | 12/1941 | Dabney | 135/137 |
| 3,847,170 | 11/1974 | Anderson | 135/147 X |
| 3,965,915 | 6/1976 | Kirkham | 135/117 X |
| 3,970,096 | 7/1976 | Nicolai | 135/117 X |
| 4,072,158 | 2/1978 | O'Brien et al. | 135/116 |
| 4,465,087 | 8/1984 | Ferguson | 135/125 |
| 5,249,592 | 10/1993 | Springer et al. | 135/125 |
| 5,301,705 | 4/1994 | Zheng | 135/125 X |
| 5,778,915 | 7/1998 | Zheng | 135/125 X |

FOREIGN PATENT DOCUMENTS

| | | |
|---|---|---|
| 3219879 | 12/1983 | European Pat. Off. . |
| WO9102870 | 3/1991 | WIPO . |

*Primary Examiner*—Carl D. Friedman
*Assistant Examiner*—Winnie Yip
*Attorney, Agent, or Firm*—Adams & Wilks

[57] ABSTRACT

A sunshade device is transformable from a folded orientation into an unfolded, fully erected orientation supported on a surface. The sunshade device has a base panel having opposite first edges and supported on the surface when the sunshade device is in the erected orientation, and a pair of side wall panels. Each of the side wall panels has a first edge respectively connected to one of the first edges of the base panel along a connecting line disposed generally horizontal to the surface when the sunshade device is in the erected orientation. The side wall panels extend generally upright and are disposed in spaced-apart relation from each other when the sunshade device is in the erected orientation. A top panel has opposite edges respectively connected with second edges of the side wall panels opposite the first edges thereof for limiting a separation distance of the second edges of the side wall panels.

45 Claims, 6 Drawing Sheets

SUNSHADE DEVICE

BACKGROUND OF THE INVENTION

Field of the Invention

The invention is concerned with sunshades which are typically used to protect holidaymakers at sunny resorts or to protect picnickers and fishermen from excessive exposure to the ultraviolet radiation in sunlight and also from elements such as wind and rain. Conventional sunshades are parasols in the form of a canopy which is stretched over a collapsible framework of pole and spokes in the manner of an umbrella. The bottom of the pole may be stuck into the ground or located in a socket in a heavy base to hold the parasol erect.

While the foregoing conventional parasols are effective when the sun is overhead, they provide poor protection in the early morning or late afternoon when the sun is low in the sky but still intense. This problem cannot be alleviated by inclining the pole as the weight of the canopy would tend to cause damage. In some cases the upper part of the pole and the canopy can tilt relatively to the lower part of the pole and although this may inhibit collapse of the parasol, inadequate protection is generally provided when the sun is low in the sky. In any case, parasol canopies are usually circular and when the sun is overhead the shade afforded thereby is also circular, which is not ideal to shield one or more reclining elongate persons unless the canopy is very large.

SUMMARY OF THE INVENTION

U.S. Pat. No. 5,301,705 discloses, in FIG. 9, a sunshade device comprising a series of first, second and third wall panels, which are connected together edge to edge in series with the remote edges of the first and third wall panels being connected by a fourth wall panel, the first and third wall panels being arranged, when the device is erected, to extend upwards as side wall panels and at least the first, second and third wall panels providing a plurality of twist-fold panels (as herein defined) which are of sufficiently similar size and shape that when folded down over one another they can be twist-folded together; and, in accordance with the present invention, such a device is characterised in that the side wall panels extend upwards from opposite edges of a base wall panel formed by the second wall panel and are arranged to be held substantially upright by at least one guy line attached to each of the side wall panels; the fourth wall panel forms a top wall panel which limits the separation of the upper edges of the side wall panels; and at least a front of the device bounded by edges of the four wall panels is open.

A person may sit or lie within the device while protected from excessive radiation or to some extent from the wind. If the device is made from waterproof material it may also be used to provide protection against rain, eg for use as a fishing shelter, although in that case it may need to have larger dimensions at the open front than when acting only as a sunshade, to allow for line casting.

The angle of the side wall panels to the vertical when the device is erected will be small, preferably within 15°, the actual angle being determined by the widths of the top and base wall panels and the height of the side wall panels. The substantially vertical side walls and the generally flat top wall panel gives the device a feeling of much greater internal roominess and airiness than do other differently constructed tent-like devices on the market.

In the present context a twist-fold panel is defined as being formed by a flexible sheet which is normally held taut in a spread position by a loop of spring wire which extends around the periphery of the sheet, the panel being collapsible by grasping the peripheral wire at spaced positions and twisting the wire in the same direction out of the plane of the loop, whereupon the wire folds into three smaller overlapping, almost coplanar loops. Subsequently, slight twisting of the smaller overlapping loops out of the overlapping configuration causes the panel to spring open to its spread position.

Although it could be round, the cross-section of the spring wire usually has a major dimension and a minor dimension, with the major dimension substantially perpendicular to the plane of the panel when in the spread position. The spring wire is preferably flat, but may have an oval or any other suitable cross-section. The wire may be made of a resilient plastic material but will more usually be made of metal.

When the sunshade device is collapsed, the twist-fold panels are folded down overlapping one another, whereupon, provided that the loops of wire have a sufficiently similar size, shape and relative disposition, the panels can be collapsed together by grasping and twisting the overlying wire loops simultaneously. The advantage of the construction is that, with the twist-fold panels collapsed, the whole device may be carried in a small flat bag, but readily erected simply by starting to untwist the smaller overlapping wire loops.

The top wall panel may also be a twist-fold panel for simultaneous collapse with the other panels but, equally, it could be a simple sheet of fabric.

In the simplest and most likely commercially successful construction, the side and the base wall panels provide respective ones of a series of three of the twist-fold panels.

Although the sizes and the shapes of the twist-fold panels provided by the side and base wall panels need not be exactly the same, they must be sufficiently similar to enable the simultaneous twist-folding. However, this provides a certain restriction in that in order to make the device wide enough to accommodate persons comfortably and with adequate ventilation, when the width of the base wall panel corresponds to the width of a twist-fold panel, the width of the base wall panel has to be reflected in the height of the side wall panels, and this may make the device undesirably high and hence subject to excessive wind pressure and excessively large when folded. This disadvantage can be overcome by forming the base wall panel as two or more similar twist-fold panels, connected together side by side and each having a size and shape sufficiently similar to one another and to the other twist-fold panels that the device may be collapsed first by folding the side twist-fold panels down over the base twist-fold panels, and then folding the base twist-fold panels over one another, prior to twist-folding all the panels simultaneously.

The rear end of the device could be open, partly closed or closed by a rear wall panel of flexible fabric and any of the side and rear wall panels may be perforate, e.g. made wholly or partly from netting or having openings for ventilation and to provide an open aspect. When for use, e.g. as a fishing shelter, fewer openings will be needed and those which are may be provided with closure flaps held in place by e.g. velcro or sliding clasp fasteners. A rear wall panel may be longer than the height of the side wall panels at the rear and not, or only partly, connected to the rear edges thereof so as to be capable of acting as a rearwardly and downwardly extending awning, eg to be pegged to the ground behind the rear edge of the base wall panel and provide, below its side edges, side openings for ventilation and openness which are open down to the level of the base wall panel. This awning will provide extra sun protection and storage area. Irrespective of the awning, if the rear wall panel does not extend down to the ground, any sand can be tipped off the base wall panel, by lifting the front of the panel. To avoid exposure to the sun through a perforate portion in a side wall panel, as the angle of the sun changes, and without having to move the device on the ground, the side wall panel may additionally be provided with an imperforate screen which is deployable over the perforate portion.

The base wall panel, effectively acts as a ground sheet and may be made of a waterproof material, such as a plastics fabric. It may also be provided with an integral additional ground sheet or sheets extending forwardly and/or rearwardly.

In order to prevent the side panels from falling over when the device is erect, at least one of the guy lines may be connected to the upper part of each side wall panel, to extend outwards and downwards to a peg to be secured in the ground. In addition at least one of the guy lines may be connected to a mid portion of each side wall panel, also to extend outwards and downwards to a peg to be secured in the ground. This latter guy is particularly useful in preventing a side wall panel from buckling inwards when subjected to direct wind pressure. Additional peg or other ground fixings may be provided around the base of the device.

The base wall panel could provide two of the twist-fold panels connected together one in front of the other, the forward one of these two twist-fold panels providing the additional ground sheet. This ensures that the additional ground sheet is held taut without the need for ground pegs.

The peripheral loops of spring wire provided in the twist-fold panels of the side wall panels will preferably be more robust than that or those in the base wall panel, and this may also be so in the top wall panel when that also provides a twist-fold panel. This is because the base and in some cases top wall panels are required only for spacing purposes and the actual strength to hold the device erect is provided by the wire loops of the side wall panels. Using less robust wire in the base wall panel and, when applicable, the top wall panel reduces the weight of the device and facilitates the twist-folding.

A convenient shape is created for the device if the side and base wall panels are generally trapezoidal with increasing width from rear to front. Thus the height and width of the interior space will increase forwardly.

The front of the top wall panel may have a forwardly projecting peak, preferably with a convexly curved front peripheral edge. This is particularly important when the side wall panels are substantially trapezoidal as the top wall panel will be backwardly tilted and, in the absence of the peak, the base wall panel (disregarding any front additional ground sheet) would extend too far forward of the front edge of the top wall panel and thereby deprive the user of necessary overhead protection.

The peak gives greater protection from solar radiation to people in or around the sunshade and/or enables the other panels to be smaller if desired whilst still providing good protection from solar radiation from above, giving a more open aspect from the side and saving in material and weight.

The peak may be formed as an integral part of a twist-fold provided by the top wall panel, to keep the material of the peak taut when in the spread position. The front of the top wall panel, at which the peak projects, is preferably the widest part of the top wall panel. Even though the twist-fold panel provided with the peak may be larger than the other twist-fold panels by virtue of the peak, it is surprisingly found that the sunshade device can still be twist-folded into smaller overlapping loops for storage or carriage, although these overlapping loops may not overlie each other fully.

Alternatively the top wall panel, may have a peak provided by a further panel associated therewith, the further panel being deployable to project beyond the front of the top wall panel, and when not deployed, the top wall panel and further panel being collapsible with the other panels of the sunshade device. The further panel, which may also be a twist-fold panel, may be connected to the top wall panel through a pivot about which the further panel is arranged to swivel to be positioned in either the deployed or a retracted position. Alternatively the further panel may be hinged along one edge to the top wall panel to enable it to be swung forwards and backwards between the deployed and retracted positions, or in yet another example arranged to slide out from, for example, a pocket on the top wall panel to contain the further panel; or pockets in the top wall panel to contain the ends of a wire or wires extending from the sides of the further panel. When the further panel is deployed to project beyond the front of the top wall panel it is preferably secured in this position by means of, for example, clips, clamps, press studs, laces or fastening straps with velcro at least partially along their length.

BRIEF DESCRIPTION OF THE DRAWINGS

Some examples of sunshade devices constructed in accordance with the present invention are illustrated in the accompanying drawings, in which.

DETAILED DESCRIPTION OF THE PREFERRED EMBODIMENTS

Figure 1:
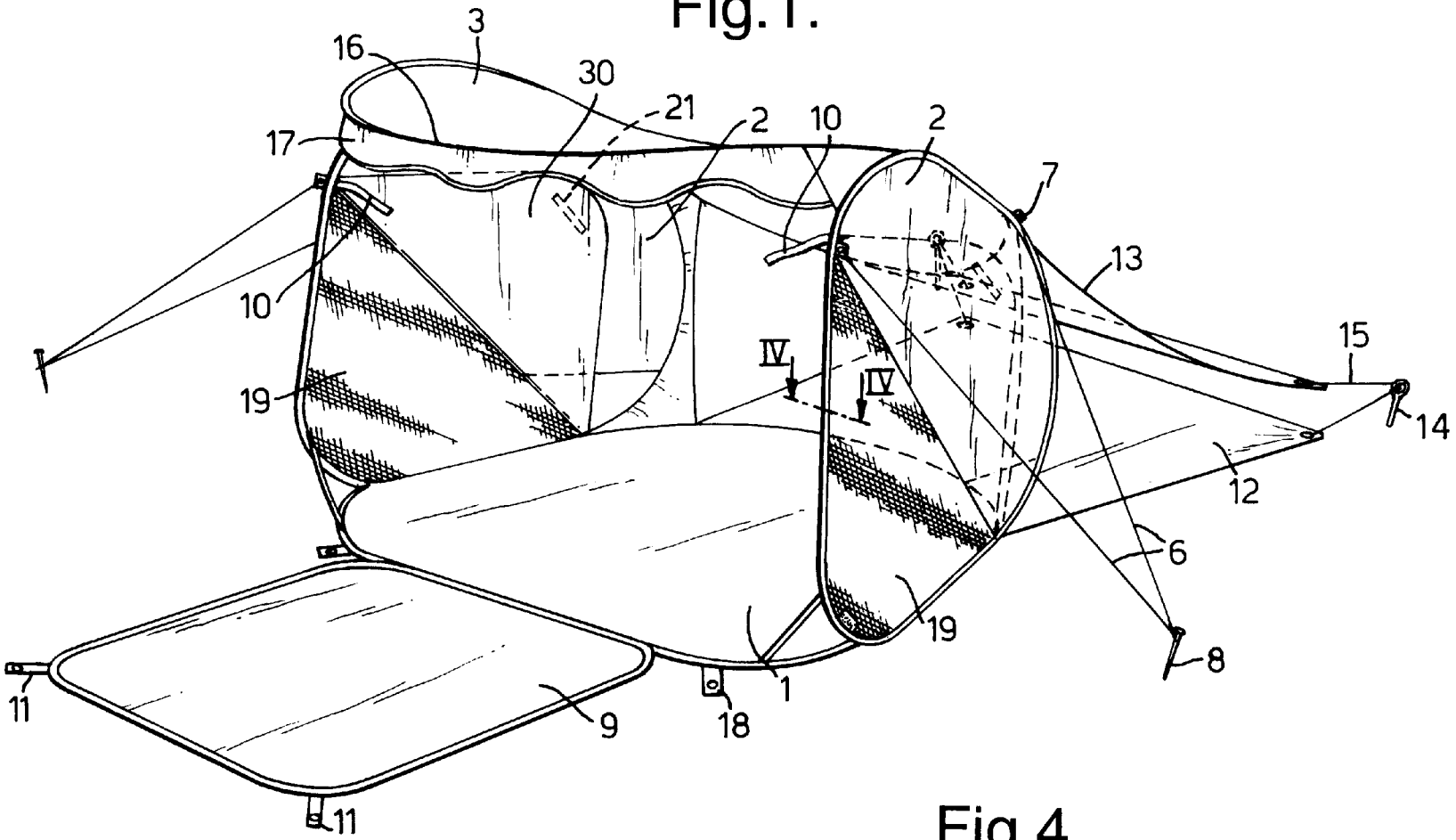
FIG. 1 is a perspective view of a first embodiment the sunshade device in an erected condition.
Figure 4:
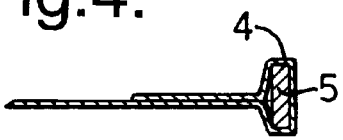
FIG. 4 is a section taken on the line IV—IV in FIG. 1.
Figure 2:
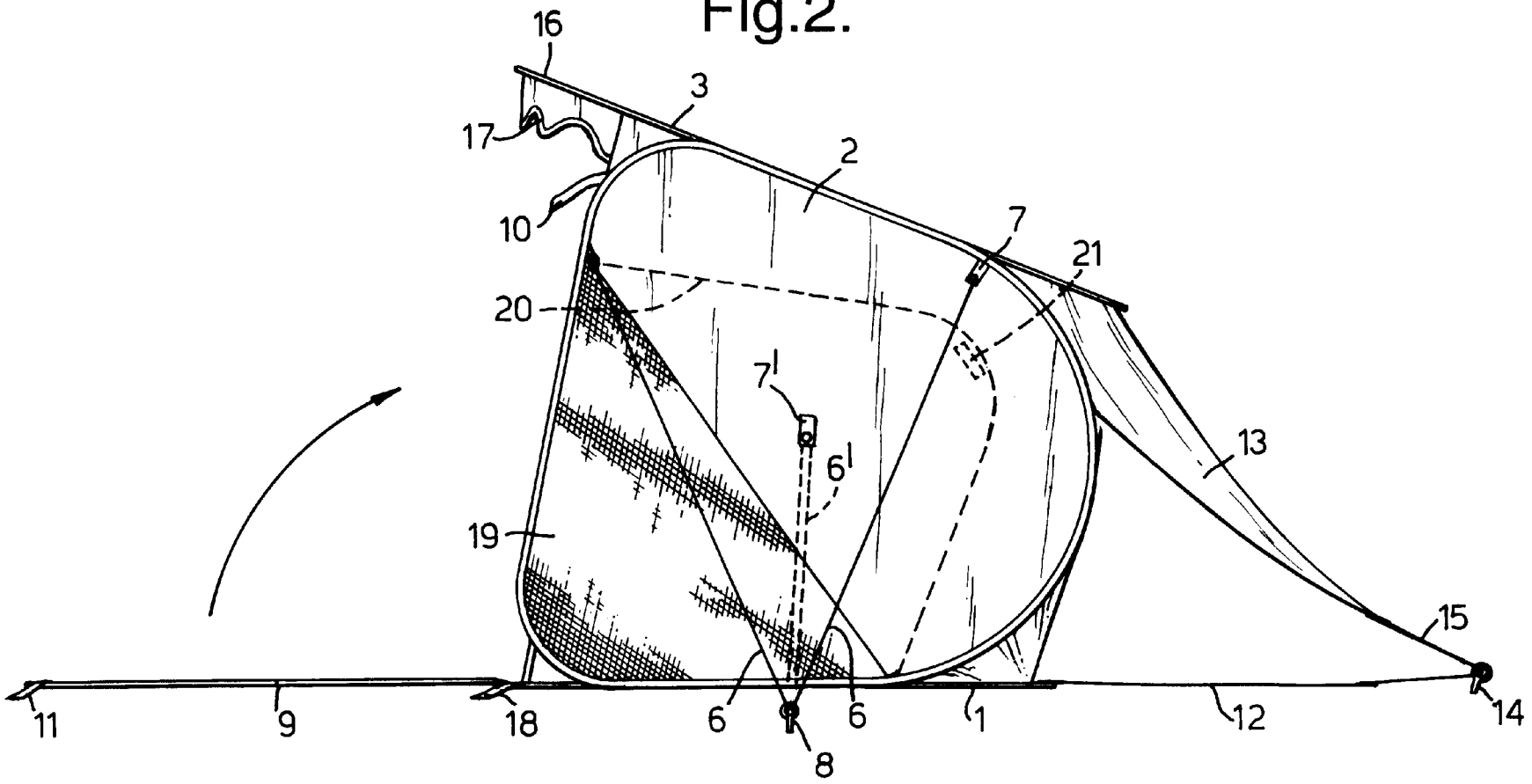
FIG. 2 is a side elevation of the sunshade device shown in FIG. 1.
Figure 3:
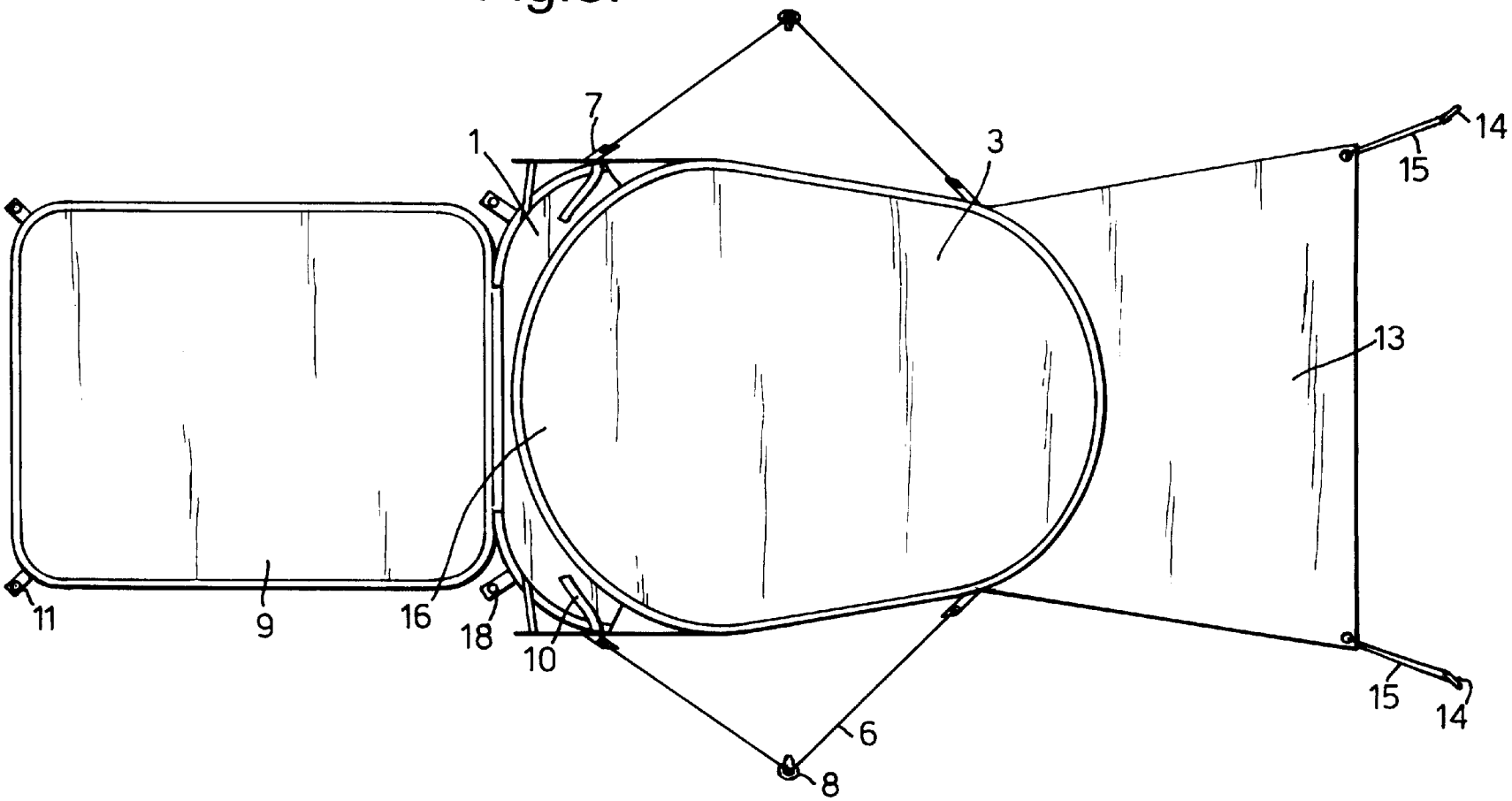
FIG. 3 is a plan view of the sunshade device shown in FIG. 1.

As particularly shown in FIGS. 1 to 5, the sunshade device (hereinafter referred to as "device") is composed of a base wall panel 1, two side wall panels 2, and a top wall panel 3, all of which are twist-fold panels having a peripheral seam 4 containing a loop of springy wire 5 of elongate cross-section. The wall panels are made essentially of a tight woven lightweight nylon fabric which is held substantially taut by the peripheral spring wire when the panels are unfolded. The base wall panel 1 is made of a material which is, or is treated to make it, waterproof and the outer faces of the top and optionally also the side wall panels, which may also be waterproof, are provided with a silvery coating to provide reflection of solar radiation. The fabric at the adjacent edges of adjacent wall panels are either continuous or sewn together to provide hinges about which the adjacent panels can rotate relatively to one another. Although this is necessary for folding the device down for transportation, some support is required to hold the device erect. This is provided in the illustrated examples by two guy lines 6, of thin cord, which are attached at respective fixing tab 7 at the edges of upper parts of respective ones of the side wall panels 2, and may be held taut by ground pegs 8. In addition there is shown in dotted lines in FIG. 2 the provision of an additional fixing tab 7' below and between the fixings 7 for a further guy line 6'. Conveniently, a single cord is reeved from one fixing tab 7, through an aperture in the peg 8, up to the tab 7' and through an aperture therein, back to and through the aperture in the peg 8 and hence to the other fixing tab 7. In this way all the guy lines can easily be pulled taut simultaneously by pulling on the peg. In this erect position the width of the top wall panel 3 determines the separation of the upper parts of the side wall panels 2 and provided that the widths of the base and top wall panels 1 and 3 are substantially the same, the side wall panels 2 will be substantially upright.

In order to increase the size of the dry and clean area on which persons using the device may rest, there is hinged in similar fashion to the front edge of the base wall panel 1 a twist-fold additional ground sheet panel 9 which, because of its peripheral wire loop, which can be quite thin, tends to remain with its fabric panel stretched taut without the need for pegs. While the rest of the device is erected, the panel 9 can be swung up through 90°, as shown by the arrow in FIG. 2, and held there by ribbons 10, which are fixed to the side wall panels and can be passed through perforated tabs 11 at the edge of the panel 9 and tied. The interior of the device then gives a degree of privacy, e.g. for changing to or from beach clothes. An additional ground sheet panel 12 is attached to the rear edge of the base wall panel 1 and may be deployed projecting rearwardly on the ground beneath an extension flap 13 forming an awning. This flap is attached to the rear edge of the top wall panel 3, and is deployed extending downwardly and rearwardly where, at each side, it is held, together with the ground sheet 12, as taut as necessary by ground pegs 14 and a cord 15. The cord 15 is attached at one end to a corner of the ground sheet 12 and at the other end to a corner of the flap 13 and passes freely through a hole in the peg 14. The gap between the rear and side edges of the ground sheet 12 and of the flap 13 allows for ventilation. For extra protection, both the ground sheet 12 and awning 13 have an increasing width in the rearward direction.

Figure 5:
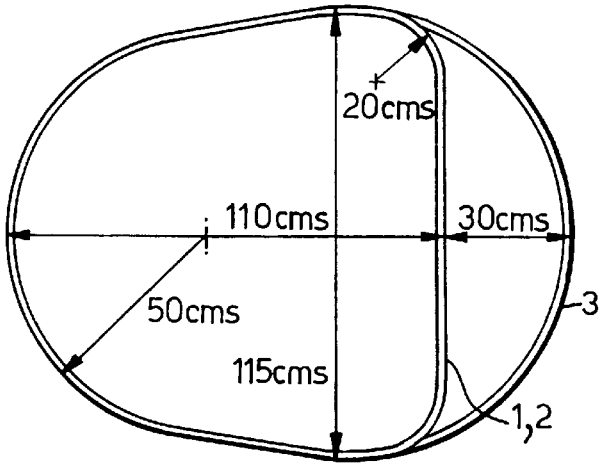
FIG. 5 is a diagram showing the dimensions of the twist-fold panels of the sunshade device according to the first embodiment.

The base and side wall panels 1 and 2 are generally trapezoidal in shape and are of the same size and shape with the dimensions and radii of curvature as shown in FIG. 5 down to the line 12. Consequently the internal width and height of the device increases from the rear to the front of the erect device, as is apparent from FIGS. 1 to 3. The top wall panel 3 also has the same size and dimensions as the wall panels 1 and 2, except for a forwardly projecting curved peak 16 from which there hangs a pelmet 17. This peak extends the top wall panel forwardly by an additional 30 cms as shown in FIG. 5 down to the line 3.

Perforated tabs 18, for receiving ground pegs, may also be provided at the bottom edges of the side wall panels for extra security against displacement by the wind.

A triangular netting window 19 is provided at the front bottom corners of each side wall panel 2, to allow for visibility and ventilation. However, if the breeze is excessive or if the sun has moved round so that it can shine through the netting undesirably, a provision is made to close these windows by providing within each side wall panel a screen in the form of a flap 20 of substantially impermeable material and of substantially the same size as the netting window. The flap is arranged either to be held folded backwards and upwards inside the respective side wall panel and to be held there by a velcro or other fastening 21, or to be folded down to cover the window 19 and to be held also in this position by a similar fastening.

Figure 6:
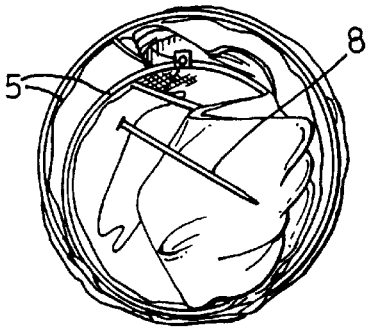
FIG. 6 shows the sunshade device according to the first embodiment in a twist-folded condition.

When it is time to fold the device for transportation, the pegs are released from the ground, the awning flap 13 and ground sheet 12 are pushed inwardly onto the base wall panel 1 and the ground sheet panel 9 is folded upwards and backwards through 180° so that it overlies the base wall panel 1. The side and top wall panels are then folded down sideways so that one side wall panel 2 is coplanar with the base wall panel 1 and underlies the top wall panel 3, with the other side wall panel 2 overlying the base wall panel 1. The top wall panel 3 and first side wall panel 2 are then folded upwards and sideways through 180° so that all five twist-fold panels then overlie the base wall panel 1. In spite of the fact that the top wall panel 3 and ground sheet panel 11 are of slightly different size and shape from the other three panels, the whole device can then be twist-folded so that the wire loops in all the twist-fold panels fall into three loops all overlying one another. In fact the illustrated device with the dimensions shown in FIG. 5 can be twist-folded into a generally circular package, as shown in FIG. 6, having a diameter of the order of 45 cms. This can readily be inserted into a bag, whereupon the device, weighing a total of about 1.9 kg can be easily carried. In order subsequently to re-erect the device, it is only necessary to displace the overlapping wire loops slightly from their twist-folded configuration, for all the panels to spring to an open position. The ground sheet panel 9 can then be unfolded, and the pegs deployed, to enable the device to be erected in a matter of seconds.

In a variation, which is not illustrated, one or both of the awning 13 and additional ground sheet 12 may be formed as a twist-fold panel, in which case the awning panel and/or ground sheet panel would be swung upwards and inwards through 180°, respectively, over the top wall panel 3 and base wall panel 1, prior to twist-folding the device for transport.

Figure 7:
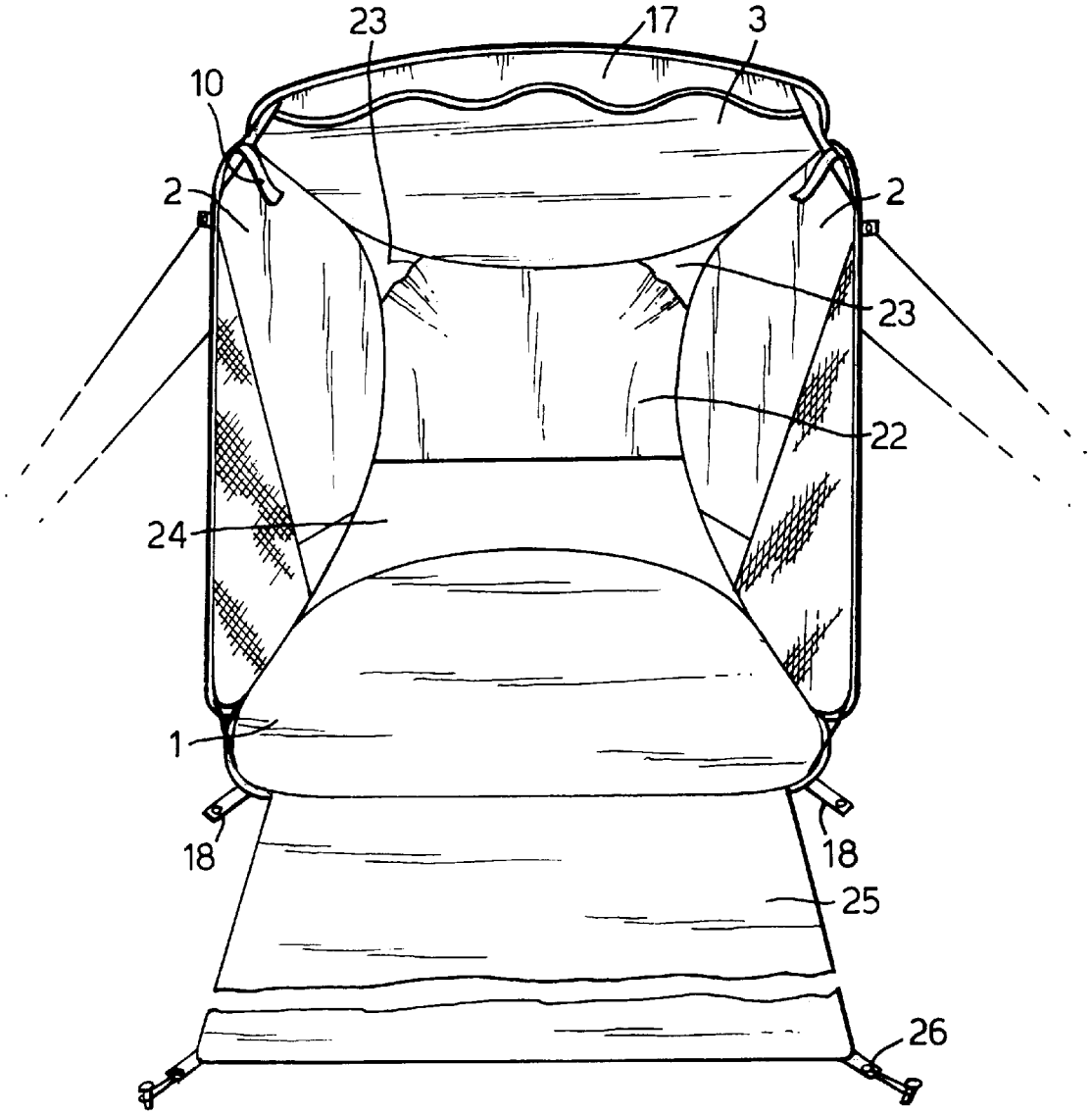
FIG. 7 is a front elevation of a sunshade device according to a second embodiment.

FIG. 7 shows a modification in which the base, side and top wall panels are the same as in the first illustrated example. There are two differences. First, instead of the ground sheet 12 and extension flap 13, the device is provided with a rear wall panel 22, which is sewn to the rear edges of the side and top wall panels 2, 3, leaving ventilation window openings 23 and 24 at the back of the device.

The second difference is that instead of the twist-fold ground sheet 9, a simple waterproof sheet 25 is connected at one edge to the front edge of the base wall panel 1, and arranged to be held deployed taut by ground pegs and perforated tabs 26 at its front corners if necessary in windy conditions.

Figure 8:
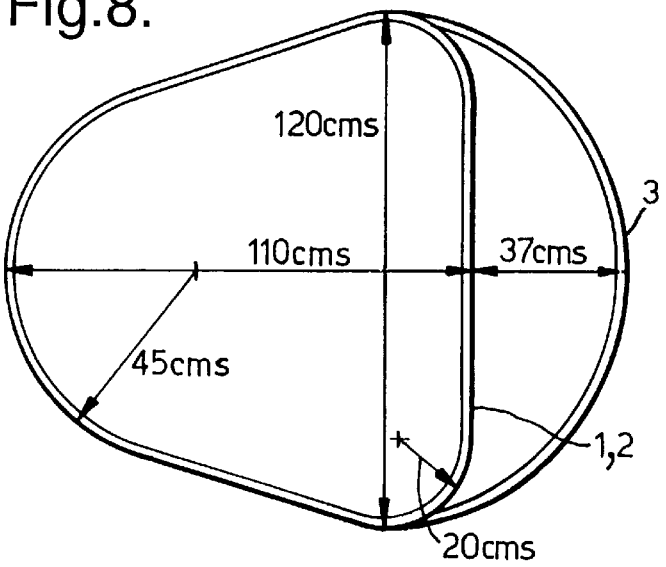
FIG. 8 is a diagram corresponding to FIG. 5 but showing the dimensions of the twist-fold panels of a sunshade device according to a third embodiment.

A third example, for use as a fisherman's shelter in good or bad weather differs from the second example of FIG. 7 in that the window openings 23 and 24 are replaced, e.g. by a single central window opening which may be closed by a flap with releasable fastenings. Also, in order to provide a larger front opening the dimensions of the twist-fold panels are as shown in FIG. 8, instead of as shown in FIG. 5.

Figure 9:
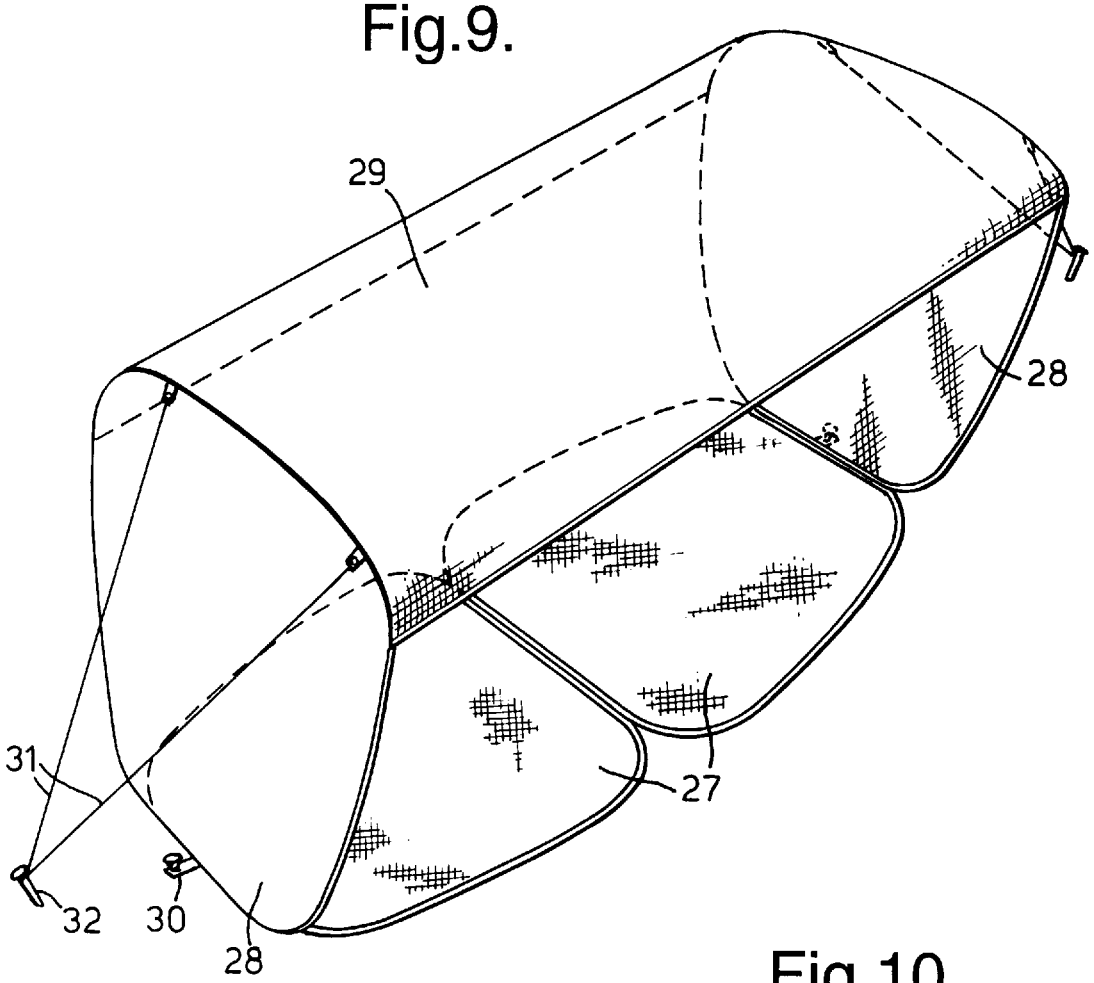
FIG. 9 is a perspective view of a sunshade device according to a fourth embodiment.
Figure 10:
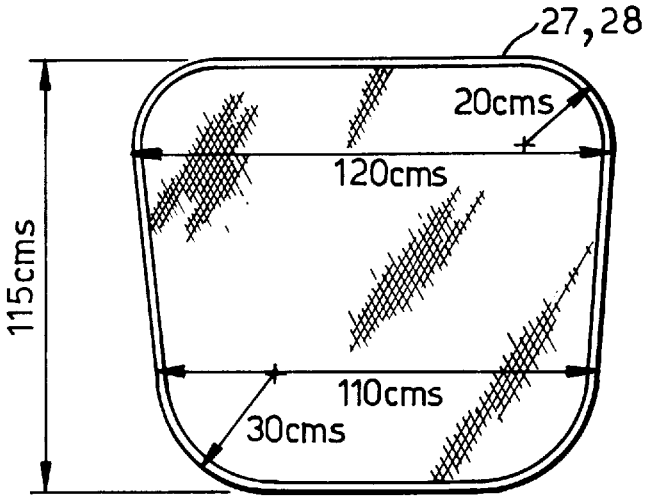
FIG. 10 is a diagram showing the dimensions of the twist-fold panels of the sunshade device according to the fourth embodiment.

The fourth example, illustrated in FIGS. 9 and 10, differs essentially from the previous examples in that the base wall panel is formed by two twist-fold panels 27, each with the generally trapezoidal shape and with the dimensions, shown in FIG. 10. The two panels 27 are hinged together at the wider ones of their parallel sides. Twist-fold side wall panels 28 of similar size and shape to the panels 27, are hinged to respective ones of the panels 27 along the respective narrower ones of their parallel sides of the trapezium. A top wall panel 29 is connected to the upper edges of the side wall panels but is not itself a twist-fold panel. The base wall panel is held by ground pegs 30 and as with the earlier examples, the side wall panels are held erect by guy lines 31 and pegs 32.

When it is desired to fold this device, with the pegs released, the side wall panels 28 are folded down onto respective ones of the panels 27, as shown by the arrows. As this happens the top wall panel 29 collapses between the other panels. One of the panels 27 and the overlying panel 28 is then folded through 180° so as to overlie the other panels 27 and 28, whereupon all four panels can be twist-folded into a smaller configuration similar to that shown in FIG. 6.

What is claimed is:

1. A sunshade device transformable from a folded orientation into an unfolded, fully erected orientation supported on a surface, the sunshade device comprising: a base panel having opposite first edges and supported on a surface when the sunshade device is in the erected orientation; a pair of side wall panels each having a first edge respectively connected to one of the first edges of the base panel along a connecting line disposed generally horizontal to the surface when the sunshade device is in the erected orientation, the side wall panels extending generally upright and being disposed in spaced-apart relation from each other when the sunshade device is in the erected orientation; and a top panel having opposite edges respectively connected with second edges of the side wall panels opposite the first edges thereof for limiting a separation distance of the second edges of the side wall panels; wherein when the sunshade device is in the erected orientation, the base panel, the side wall panels and the top panel define a front end and a rear end of the sunshade device with at least the front end being open; and wherein at least the base panel and the side wall panels comprise twist-fold panels of sufficiently similar size and shape such that when folded down over one another about the connecting lines they can be twisted and folded to transform the sunshade device from the unfolded, fully erected orientation into the folded orientation.

2. A sunshade device according to claim 1; further comprising sheet panel integrally connected to the base panel and arranged to be deployed on the surface forwardly of the front end of the sunshade device when the sunshade device is in the erected orientation.

3. A sunshade device according to claim 2; wherein the top panel comprises a twist-fold panel of sufficiently similar size and shape as the base panel and the side wall panels such that when folded down over one another they can be twisted and folded to transform the sunshade device from the unfolded, fully erected orientation into the folded orientation.

4. A sunshade device according to claim 2; wherein the base panel comprises two twist-fold panels connected together one in front of the other, the forward one of the two twist-fold panels defining the sheet panel.

5. A sunshade device according to claim 2; wherein the base panel comprises two or more twist-fold panels connected together side by side between the side wall panels.

6. A sunshade device according to claim 3; wherein each of the twist-fold panels comprises a peripheral seam containing resilient wire.

7. A sunshade device according to claim 6; wherein the resilient wire of the twist-fold panels defined by the side wall panels has a higher strength than the resilient wire of the twist-fold panel defined by the base panel.

8. A sunshade device according to claim 3; wherein the bass panel comprises two twist-fold panels connected together one in front of the other, the forward one of the two twist-fold panels defining the sheet panel.

9. A sunshade device according to claim 8; wherein the forwardly projecting peak is formed in one piece with the top panel.

10. A sunshade device according to claim 9; wherein the forwardly projecting peak has a front, convexly curved peripheral edge portion.

11. A sunshade device according to claim 3; wherein an end of the top panel at the front end of the sunshade device has a forwardly projecting peak.

12. A sunshade device according to claim 1; wherein the base panel comprises two or more twist-fold panels connected together side by side between the side wall panels.

13. A sunshade device according to claim 1; wherein the top panel, the sides wall panel and the base panel define an interior space when the sunshade device is in the erected orientation; and wherein the base panel and the side wall panels are generally trapezoidal in shape such that when the sunshade device is in the erected orientation the interior space of the sunshade device increases in height and width from the rear end to the front end thereof.

14. A sunshade device according to claim 1; further comprising at least one guy line connected to an upper portion of each of the side wall panels when the sunshade device is in the erect orientation for supporting the side wall panels substantially upright.

15. A sunshade device according to claim 1; further comprising at least one guy line connected to a central portion of each of the side wall panels when the sunshade device is in the erected orientation for supporting the side wall panels substantially upright.

16. A sunshade device according to claim 1; wherein a portion of at least one of the side wall panels is perforated.

17. A sunshade device according to claim 16; wherein the at least one side wall panel has a substantially imperforate screen which is deployable over the perforated portion of the at least one side wall panel.

18. A sunshade device according to claim 1; further comprising a pelmet projecting downwardly from an end of the top panel at the front end of the sunshade device.

19. A sunshade device according to claim 1; wherein an end of the top panel at the front end of the sunshade device has a forwardly projecting peak.

20. A sunshade device according to claim 19; wherein the forwardly projecting peak has a convexly curved peripheral edge portion.

21. A sunshade device according to claim 1; further comprising means defining ventilation openings at the rear end of the sunshade device when the sunshade device in in the erected orientation.

22. A sunshade device according to claim 21; wherein at least one of the ventilation openings opens down to a position substantially level with the base panel.

23. A sunshade device according to claim 22; further comprising an awning extending rearwardly and downwardly from an end or the top panel at the rear end or the sunshade device when the sunshade device is in the erected orientation.

24. A sunshade device according to claim 23; wherein a width of the awning increases in the rearward direction.

25. A sunshade device according to claim 23; wherein a width of the awning increases in the rearward direction.

26. A sunshade device according to claim 21; further comprising an awning extending rearwardly and downwardly from an end of the top panel at the rear end of the sunshade device when the sunshade device is in the erected orientation.

27. A sunshade device according to claim 26; wherein a width of the awning increases in the rearward direction.

28. A sunshade device according to claim 21; wherein the means defining ventilation openings comprises a rear panel connected to the side wall panels and the top panel.

29. A sunshade device according to claim 1; wherein each of the twist-fold panels comprises a peripheral seam containing resilient wire.

30. A sunshade device according to claim 29; wherein the top panel comprises a twist-fold panel of sufficiently similar size and shape as the base panel and the side wall panels such that when folded down over one another they can be twisted and folded to transform the sunshade device from the unfolded, fully erected orientation into the folded orientation.

31. A sunshade device according to claim 30; wherein the resilient wire of the twist-fold panels defined by the side wall panels has a higher strength than the resilient wire of the twist-fold panel defined by the top panel.

32. A sunshade device according to claim 30; wherein the resilient wires of the twist-fold panels defined by the side wall panels have a higher strength than the resilient wire of the twist-fold panel defined by the top panel.

33. A sunshade device according to claim 32; wherein the base panel comprises two twist-fold panels connected together one in front of the other, the forward one of the two twist-fold panels defining the sheet panel.

34. A sunshade device according to claim 1; further comprising an awning extending rearwardly and downwardly from an end of the top panel at the rear end of the sunshade device when the sunshade device is in the erected orientation.

35. A sunshade device transformable from a folded orientation into an unfolded, fully erected orientation, the sunshade device comprising: a base panel having opposite first edges; a pair of side wall panels each having a first edge respectively connected to one of the first edges of the base panel, the side wall panels extending generally upright and being disposed in spaced-apart relation from each other when the sunshade device is in the erected orientation; a top panel having opposite edges respectively connected with second edges of the side wall panels opposite the first edges thereof for limiting a separation distance of the second edges of the side wall panels when the sunshade device is in the erected orientation; and at least one guy line connected to each of the side wall panels when the sunshade device is in the erected orientation for supporting the side wall panels substantially upright; wherein at least the base panel and the side wall panels comprise twist-fold panels of sufficiently similar size and shape such that when folded down over one another they can be twisted and folded to transform the sunshade device from the unfolded, fully erected orientation into the folded orientation.

36. A sunshade device according to claim 35; wherein when the sunshade device is in the erected orientation, the base panel, the side wall panels and the top panel define a front end and a rear end of the sunshade device with at least the front end of the sunshade device being open.

37. A sunshade device according to claim 35; further comprising a sheet panel integrally connected to the base panel and arranged to be deployed forwardly of the front end of the sunshade device when the sunshade device in in the erected orientation.

38. A sunshade device according to claim 37; wherein the base panel comprises two twist-fold panels connected together one in front of the other, the forward one of the two twist-fold panels defining the sheet panel.

39. A sunshade device according to claim 35; wherein the top panel comprises a twist-fold panel of sufficiently similar size and shape as the base panel and the side wall panels such that when folded down over one another they can be twisted and folded to transform the sunshade device from the unfolded, fully erected orientation into the folded orientation.

40. A sunshade device according to claim 39; wherein each of the twist-fold panels comprises a peripheral seam containing resilient wire.

41. A sunshade device according to claim 40; wherein the resilient wires of the twist-fold panels defined by the side wall panels have a higher strength than the resilient wire of the twist-fold panel defined by the top panel.

42. A sunshade device according to claim 35; wherein the base panel comprises two or more twist-fold panels connected together side by side between the side wall panels.

43. A sunshade device according to claim 35; wherein the top panel, the side wall panels and the base panel define an interior space when the sunshade device is in the erected orientation; and wherein the base panel and the side wall panels are generally trapezoidal in shape such that when the sunshade device is in the erected orientation the interior space of the sunshade device increases in height and width from the rear end to the front end thereof.

44. A sunshade device according to claim 35; wherein a portion of at least one of the side wall panels is perforated; and further comprising an imperforate screen connected to the at least one side wall panel for deployment over the perforated portion thereof.

45. A sunshade device according to claim 35; wherein when the sunshade device is supported on a surface in the erected orientation, the first edge of each of the side wall panels is connected to the respective first edge of the base panel along a connecting line disposed generally horizontal to the surface.

* * * * *